United States Patent [19]

Kronseder

[11] Patent Number: 4,789,013

[45] Date of Patent: Dec. 6, 1988

[54] MACHINE FOR FILLING CONTAINERS SUCH AS BOTTLES

[76] Inventor: Hermann Kronseder, Regensburger Strabe 42, 8404 Wörth/Donau, Fed. Rep. of Germany

[21] Appl. No.: 129,833

[22] Filed: Dec. 8, 1987

[30] Foreign Application Priority Data

Dec. 13, 1986 [DE] Fed. Rep. of Germany ..... 3642722

[51] Int. Cl.[4] ..... B65B 3/00; B67C 3/22

[52] U.S. Cl. ..... 141/177; 141/145; 141/147

[58] Field of Search ..... 141/145, 147, 177

[56] References Cited

U.S. PATENT DOCUMENTS 897,420 9/1908 Small ..... 141/145
4,676,286 6/1987 Aiuola et al. ..... 141/147 X

FOREIGN PATENT DOCUMENTS 1145084 3/1963 Fed. Rep. of Germany ..... 141/145
2100284 5/1974 Fed. Rep. of Germany .
3241435 5/1984 Fed. Rep. of Germany .
8511614 10/1985 Fed. Rep. of Germany .

*Primary Examiner*—Timothy F. Simone
*Assistant Examiner*—K. L. O'Leary
*Attorney, Agent, or Firm*—Fuller, Puerner & Hohenfeldt

[57] ABSTRACT

A container filling machine has a rotor which is adjustable in height and supports components for filling containers. A carrier support is mounted to support devices which are adjustable vertically on stationary columns. Interlock elements which are arranged radially on the rotor are operable to unlatch the support devices at a specific rotational position of the rotor and to support the support devices and carrier. The lever-shaped latch element of each support device projects into a recess for the interlock element in such a way that with a partial penetration of the interlock element into the support device the support device is still latched to the column but supported and further penetration of said interlock element results in the support device being unlatched so that when the height of the rotor is altered, the support devices and carrier are altered in height correspondingly.

14 Claims, 3 Drawing Sheets

MACHINE FOR FILLING CONTAINERS SUCH AS BOTTLES

BACKGROUND OF THE INVENTION

This invention relates to a machine for filling containers such as bottles with a liquid.

Bottle filling machines may be comprised of an annular tank or bowl which contains the liquid with which the bottles are to be filled. Several filler valves are mounted to the bowl and they are arranged to pass over conveyed bottles. The bowl is mounted on a platform or table which rotates in a horizontal plane about a vertical axis that is coaxial with the annular ring bowl. There may be vertical lead screws or other lifting devices mounted on the platform which runs on a circular track on which the bowl rotates The lead screws or other form of lifting and lowering devices are activated to change the height of the bowl and the filler valves mounted thereto when the machine must be adapted for filling bottles of various heights. When the height of the bowl and the filler valves carried on it is changed, the valve operating devices and cam tracks and the like, which are usually arranged concentrically to the bowl, must also undergo a change in height It is desirable to be able to convert the machine for switching from one container or bottle size to another as rapidly as possible and to minimize the number of machine components that must be adjusted individually. It is also important that components which rotate with the bowl maintain the proper angular relationship with respect to machine components arranged adjacent the bowl. In one known type of filling machine, a rotor which supports filler valve operating devices and a carrier support for other control components, is adjustable in height on stationary columns and is fixed in place by means of clamping devices which must be individually actuated manually. The rotor and carrier support are capable of being connected with each other with pronged couplings for the purpose of adjusting all components uniformly.

Accomplishing positive interlocking between the carrier supports and rotor and release of the couplings for freeing the rotor for continuing filling operations, requires a series of manual disassembly and reassembly operations which are time consuming and hazardous in a sense because the machine attendants must get up to the highest point of the machine to make certain changes.

In German Patent DE-AS No. 2,100,284, a container filling machine is shown wherein control elements for the filling valves are moved vertically by means of a height adjustable holder which is arranged on vertical supports for locating all the machine components involved in filling at a height appropriate to the height of the containers being filled. In the patented machine, there is a mechanically actuatable height adjustment which has separate drives for, on the one hand, the upper part of the machine with the bowl and filling valves and on the other hand, for the mount of the support devices for the carrier of the control elements for the filler valves. The supports for the mount of the height adjustment are each individually provided with lead screws and parts of a gearing unit are connected to each other by an intermediate shaft. The gear units are driven by a motor which operates various drive chains having different speeds. The low rpm drive chain thereby either acts on the mount by means of the supports or acts on the upper part of the machine by means of the carrier columns. Thus, a guiding drive with one of the height adjustable parts of the machine is formed while the high rpm drive chain which is in contact with the other height adjustable part of the machine constitutes a follow-up drive. This arrangement is extremely complex, technical and costly. Furthermore, the follow-up control permits a certain amount of freeplay or dislocation, as a result of which there is a lack of certainty as to the relationship between the filling valve carrying bowl on the rotor and the carrier support for the control components.

German Offenlegungsschrift DE-OS No. 3,241,435 shows another arrangement for obtaining height adjustment in a filling machine. In this laid open application, control is accomplished by means of a carrier support provided with a height adjusting device for achieving height positioning of various machine components. In this arrangement, a positioning drive associated with the height adjustment device is capable of being switched on for an appropriate length of time, and after achieving the desired vertical elevation, can be switched off again. Particularly, the positioning drive for the carrier support should be capable of switching on and off in response to signals such that the positioning drive functions under the influence of a motor having a brake and the electrical circuit components are based on digital technology.

The height adjustment device referred to in the preceding paragraph is basically a type having a worm gear, an endless screw, and a gear and threaded spindle connected with a drive motor and its gear reduction device. The power transferred by means of a chain to the height adjustment device and its telescopic arrangement with an arm extending to the bowl furthermore makes the arrangement and the procedure particularly complex and problematical.

Still another existing container filling machine has the carrier support for the control components supported by means of several holders situated on stationary columns and movable in height as in German Gebrauchsmuster DE-GM No. 85 11 614. Each clamp or holder has an L-shaped clamping arm which can be opened or closed by means a pneumatic cylinder and there is a swivelable interlock which is operated by a second pneumatic cylinder and can enter into a dog-like component arranged on the filling machine bowl. This type of filling machine is costly to construct and requires a complicated control system for both groups of pneumatic cylinders. This is because there must be assurance that all interlocks are engaged before the clamping installation can be released in order to avoid an unwanted dropping of the parts with the carrier support. Conversely, all clamping devices must first be closed before the interlocks can be disengaged. Any height adjustment requires a high degree of attention and concentration on the part of service personnel.

SUMMARY OF THE INVENTION

The main object of the invention disclosed herein is to provide improved means for adapting a container filling machine for filling bottles having a range of heights wherein the range of height adjustment is carried out with minimum service personnel involvement and in the shortest time with high accuracy.

For the sake of brevity, the term "bottle" will be used in the description as generic to various types of containers which can be filled with liquid by the improved machine.

The invention employs the basic concept of an interlock using a sliding bolt between a height adjustable rotor carrying a liquid containing bowl and guide or support devices arranged on columns wherein the devices are connected to a carrier which contains the control components for operating the filling valves mounted to the bowl, for example.

The rotor which carries the liquid containing bowl can have its height altered for bottles of different heights by means of a plurality of lead screws. For the purpose of accomplishing concurrent height adjustment of the rotor and carrier support, these members are coupled during height adjustment by using pneumatic cylinders to drive interlock bolts into the vertically adjustable support devices on stationary columns at the outset of a height adjustment procedure. The support devices contain latch elements which latch the devices and carrier supports to the stationary vertical columns. In accordance with the invention, as soon as each of the plurality of interlock bolts are actuated sufficiently to enter the support devices, the rotor supported bowl becomes supported by the devices. At this time, raising of the rotor and bowl supported thereon will not begin because the support devices are still latched to the columns. On further projection of the pneumatically driven interlock means in the form of slide bolts, the latches become disengaged. Now, when the bowl with the filler valves thereon is raised or lowered to a height appropriate to the height of bottles that are to be filled, the bolt carries the carrier upwardly or downwardly in which case the valve operating components or other components on the carrier are adjusted in an interlocked fashion to maintain the height relationship they had with the filler valves before the height adjustment was initiated. Finally, the sliding bolt is partially retracted; at which time the latches are released from engaging with a toothed rack on the stationary columns. Thus, there is assurance that the carrier support will be secured at the appropriate height before the rotor and bowl are allowed to rotate again for filling bottles. The support devices are continued to be supported on the interlock bolts when the bolts are partially retracted to assure that the latches have acted to engage the support devices with the columns again before the bolts are fully retracted.

The arrangement is particularly advantageous since no manual locking is involved and all control operations involved with coupling and uncoupling the rotor and carriers can be controlled simultaneously from a central operating station.

A more detailed description of the embodiments of the invention will now be described in reference to the drawings.

DESCRIPTION OF THE PREFERRED EMBODIMENT

Figures 1, 2:
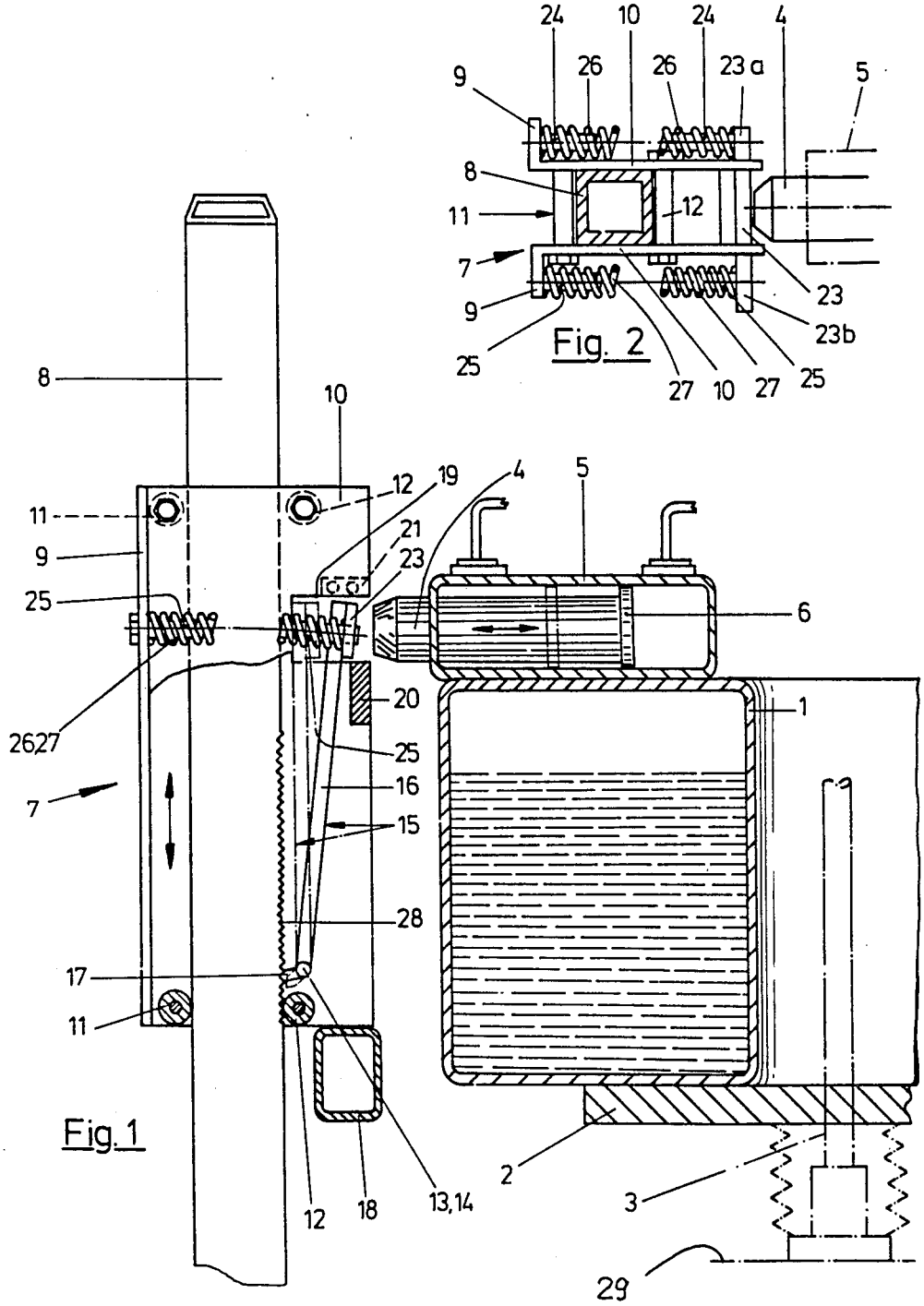
FIG. 1 shows one side of an annular liquid containing bowl 1 in section mounted on a table or rotor 2 for rotating on a stationary track, these parts being located adjacent a plurality of columns 8 arranged in spaced relationship around the rotor and support devices 7 presently latched to the columns for supporting a carrier for machine parts involved in operating filler valves, not shown, mounted to the bowl at a height appropriate to the height of bottles that are being filled.
FIG. 2 is a plan view of the coupling or support device depicted in FIG. 1.

In FIGS. 1 and 2 only the parts involved in adapting the bottle filling machine for accommodating bottles of different heights are shown. Some of the parts are illustrated schematically.

In FIG. 1, a section through one side of the annular tank, called a ring bowl 1, is shown. An annular liquid storage bowl with bottle filler valves installed is shown in U.S. Pat. No. 4,637,438 which is assigned to the assignee of this application. The disclosure of this patent is incorporated herein by reference. Annular liquid containing bowl 1 is mounted fixedly to a table-like rotor 2, shown fragmentarily, which rotates about an axis concentric with the annular bowl 1. The rotor is carried on the lead screws 3 which threadingly engage rotatable table 2 for raising and lowering the rotor. There are usually six or more such lead screws angularly spaced apart around the rotor. The height adjustment lead screws are mounted to a carriage 29 which rotates on a circular stationary track, not shown. The height adjustment of the rotor including filler valve carrying bowl 1 must be raised and lowered coordinately with other components that lie radially outwardly of the bowl to maintain proper relationships between the parts when a height adjustment is made. To achieve this, a plurality of stationary square cross sectioned columns 8 are arranged around bowl 1 on the rotor. There are support devices, generally designated by the numeral 7, mounted to these columns. During regular filling operations, support devices 7 are latched to the columns and uncoupled from the rotor. The supporting devices 7 are comprised of two similar parallel walls or plates 10 which have edges or flanges 9 formed integrally with and at right angles to them. There are, in this design, pairs of spacers 11 and 12 installed between the parallel walls 10 of the clamping device to maintain a constant dimension between the walls. The walls 10 and all parts carried on them including carrier ring 18 are movable vertically on columns 8 when unlatched.

There is a diagramatically shown pneumatic cylinder 5 mounted on top of bowl 1 for each one of the support devices 7 that is arranged around the bowl. Thus, the pneumatic device contains a piston 6 which forms part of an interlock slide bolt 4 that is tapered or conically shaped at its leading end. Air pressure on the right side of piston 6 causes bolt 4 to be driven into engagement with support device 7 and air pressure on the left side of piston 6 causes the lock bolt 4 to be retracted or uncoupled from the clamping device 7. The interlock means 4 could have a shape that would characterize it as being other than a bolt.

As indicated, the carrier support 18 for cams and valve operating devices, not shown, is essentially a horizontal ring fastened to circularly arranged support devices 7. As shown especially clearly in FIG. 1, there are two cross bars 20 and 21 fixed between and spanning the distance between side walls 10. The space between the bars 20 and 21 constitutes a gate or passageway for interlock bolt 4 to enter into support device 7 to establish a coupling. The rotor, of course, has to be stopped so that the various bolts 4 are aligned with the support devices 7 when a height adjustment is to be undertaken.

The first phase of bolt 4 operation is characterized by the bolt entering or penetrating partially the space between the bars 20 and 21 so as to be in the position for establishing mutual support between the rotor which supports bowl 1 and the support devices 7.

Figure 3:
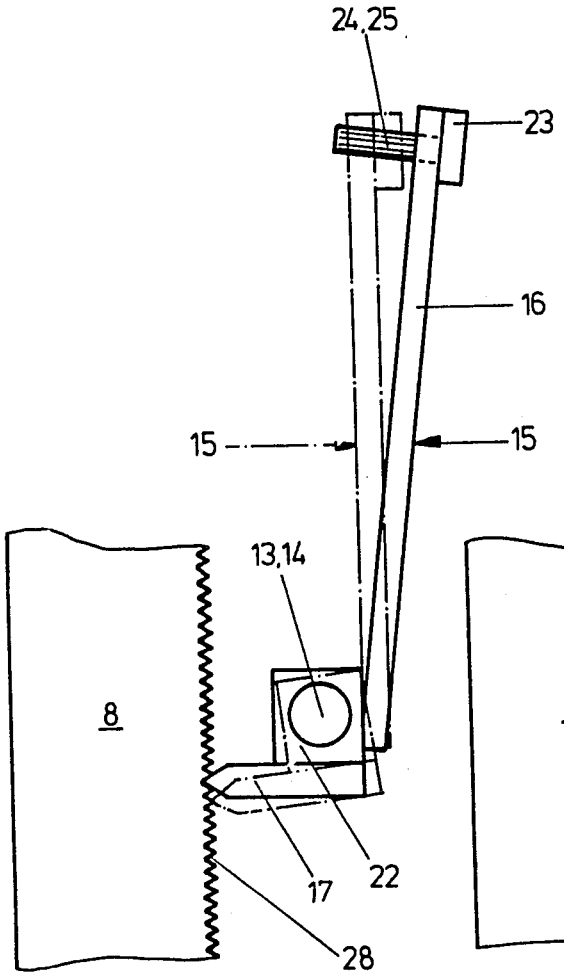
FIGS. 3, 4 and 5 show different types of latches that can be used in the coupling or support devices for engaging the rotor with the stationary filler valve operating component carriers.

There is a rectangular recess 19 in each of the side walls 10 of support devices 7 and these recesses or slots are congruent or aligned. An actuating element or latch member 15 constituting a long lever arm 16 and a short latching arm 17 is provided with trunnions 13 and 14 for swinging between a solid line position and a phantom line position as shown in FIG. 1. Latch member 15 has a cross bar 23 fastened at its upper end and, as can be seen in FIG. 3, this cross bar can fit through recess 19 with side extensions 23*a* and 23*b* projecting laterally outwardly of walls 10. The trunnions 13 and 14 of latch member 15 are journaled on side plates 10 so when long arm 16 of the lever type latch member is angulated as indicated in solid lines in FIG. 1, the short arm 17 of the lever engages with a toothed rack 28 which is mounted to the stationary vertical columns 8. FIG. 3 shows how the short arm 17 of latch member lever 15 is beveled or sharpened so as to make positive engagement in toothed rack 28 so that support device 7 cannot fall downwardly under the influence of gravity until the short lever 17 is unlatched and disengaged from the toothed rack. A pair of springs 26 and 27 are interposed between the flanges 9 on the side walls 10 and the extensions 23*a* and 23*b* of the cross bar 23 at the upper end of lever portion 16. Extension 23*b* and flange portion 9 have pins or lugs 25 projecting from them for retaining spring 27. Similarly, on the other side, flange 9 and extension 23*a* have lugs 24 extending from them for retaining spring 26. These springs act on a long moment arm equal to the length of long lever portion 16 for firmly engaging the wedged shaped end of short lever arm 17 with the toothed rack or indentations on column 8.

As previously mentioned, the interlock bolt 4 can be driven outwardly from cylinder 5 and retracted into the cylinder by means of piston 6. The interlock bolt 4 could be biased inwardly of the cylinder 5 by means of a spring, not shown, around the body of the lock bolt 4, inside of the cylinder in which case a single action pneumatic cylinder could be used. In accordance with the invention, when the interlock means in the form of sliding bolt 4 is driven outwardly from cylinder 5, it immediately acts to support device 7 and all load that is carried on it. When the lock bolt 4 is driven further, it strikes cross bar 23 on long lever arm 16 so as to overcome the bias on the springs and rotate lever 16 counterclockwise. Upon this event, the support device 7 finally becomes disengaged from column 8 by reason of short lever 17 becoming disengaged from the toothed rack or indentations 28 on column 8. Now, the lead screws 3 or other suitable lifting device for the rotor 2 and bowl 1 can be actuated to change the height of the rotor. At the same time, by reason of interlock bolt 4 now supporting the support device 7 and the support device being unlatched from the column 8 as a result of lever 16 being pushed to a vertical position by the interlock bolt, the whole supporting device 7 and carrier 18 and everything mounted to carrier 18 will raise or lower with the rotor. When the rotor and all of the support devices 7 are elevated appropriately for the height of the bottles which are to be filled, lock bolt 4 is retracted. As a result, the springs 26 and 27 are able to rotate the long lever arm 16 and the short lever arm 17 clockwise as viewed in FIG. 1 in which case the beveled end of the short lever arm 17 engages or latches into toothed rack 28. The bolt 4 continues to support the support means 7 until the latch has a chance to engage since while the bolt is only partially retracted the bar member 21 is still resting on the bolt. When the bolt is fully retracted, rotor 2 and bowl 1 are free to rotate for positioning the filler valves, not shown, that are mounted to the bowl 1 for filling bottles.

Figure 4:
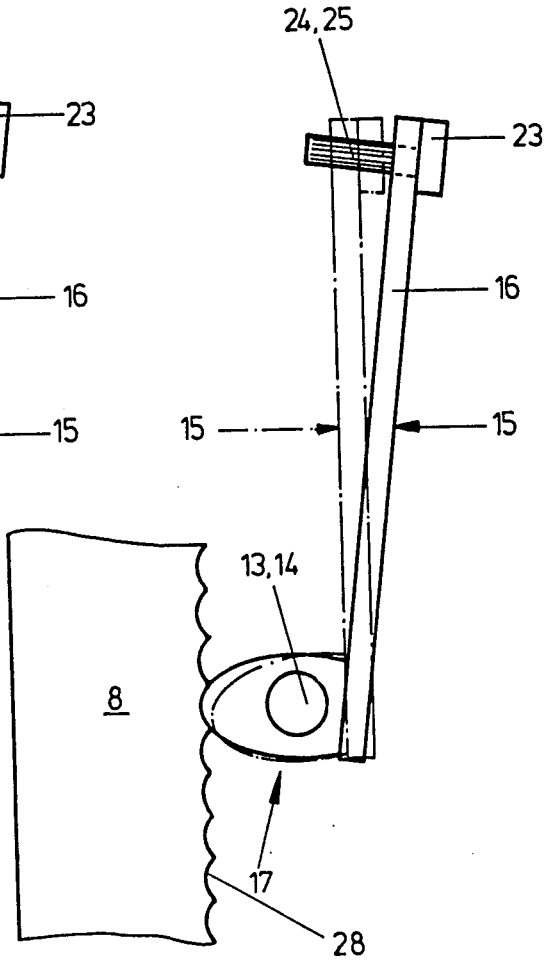

FIG. 4 shows an alternative form of latching lever or actuator 15. In this case, the short arm 17 has a generally elliptical shape terminating in a round end that fits complementarily with correspondingly curved indentations 28 in stationary column 8.

Figure 5:
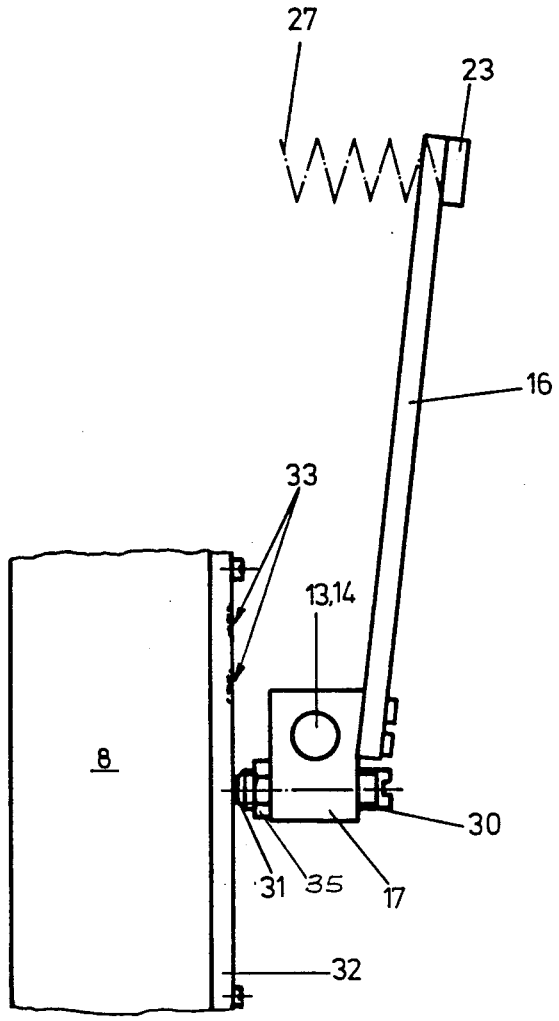

Another embodiment of a latch lever for the clamping device is shown in FIG. 5 where, as in the preceding FIGURES, parts having the same function are given the same reference numerals. In FIG. 5, there are two thrust bolts 30 screwed into the short lever arms 17 and secured by lock nuts 35. The thrust bolts 30 have hardened tips 31 pointed toward columns 8. There is a metal bar 32 fastened along one face of column 8. The exposed face of bar 32 is smooth when it is new. After numerous height adjustments, the hardened tips 31 of the thrust bolts 30 cause permanent imprints or recesses 33 to be developed in bar 32. These imprints 33 improve the holding ability of the support device 7. The tips 31 can be flat, or preferably, spherical.

Operation of the device is recapitulated. During normal bottle filling operation, all of the interlocking bolts 4 are retracted into the cylinders as shown in solid lines in FIG. 1. Bowl 1 is free to rotate with rotor 2 as it does when bottle filling operations are being conducted. Control elements, not shown, mounted to carrier support 18 act on the filling valves, not shown, fastened on the underside of bowl 1 and, thus, the filling procedure is controlled. If height adjustment is required to switch to taller or shorter bottles, then the normal rotation of the rotor 2 and bowl 1 are terminated. The rotor then slowly proceeds into a position in which the interlock bolts 4 lie directly opposite of the support devices 7 aligned with the recess 19 formed between cross bars 20 and 21. All of the air cylinders 5 are then operated and all of the interlock bolts 4 extend. First of all a connection is made between the support device 7 and the rotor bowl 1 as the bolts 4 enter at least partially in between the coupling bars 20, 21 and the edges of slots 19. The outermost tips of the interlock bolts then strike the actuation lever 16 and swivel it until the bolt reaches its radially outer end position. Then the latching of support devices to columns 7 is released and the carrier support 18 and devices, not shown, mounted thereon are not able to move vertically relative to column 8 because the support devices 7 are supported on interlock bolts 4. The rotor is then changed to a new height. Then, every interlock bolt 4 is retracted by the compressed air cylinders or springs if single acting cylinders are used. However, the support of the support devices 7 on the interlock bolts is maintained until the springs 25 and 26 have driven the actuating device clockwise to cause the short lever 17 to engage with the teeth or other indentations on column 8.

I claim:

1. A container filling machine comprising:

a height adjustable rotor and devices for filling containers supported on said rotor, at least one stationary column arranged radially outwardly of said rotor, a support device mounted on the column, for moving vertically, a carrier member mounted on the support device for supporting devices that cooperate with at least one device on the rotor, a latch member mounted movably on said support device, said latch member when in one position engaging the support device to said column to prevent movement of said support device and when in another position disengaging said support device from said column, an interlock element mounted on said rotor, said element being actuatable to advance in one direction to engage said support device for said support device to be supported on said interlock element so when the height of said rotor is adjusted said support device will follow corresponding, and said interlock element being alternatively actuatable in an opposite direction to disengage said support device and permit said rotor to rotate, a coupling element mounted to said support device, actuation of said interlock element a predetermined amount in said one direction causing said interlock element to be in a position to support said support device on said coupling element and further actuation of said interlock element in said one direction causing said latch member to disengage said latch member from said column.

2. The machine according to claim 1 wherein actuation of said interlock element by a predetermined amount in said opposite direction allows said latch member to reengage said column and further actuation of said element in said opposite direction removes said element from the position wherein it can support said support device.

3. A machine according to claim 1 wherein said interlock element comprises a bolt mounted on said rotor for being actuated radially of said rotor, said coupling element and another spaced apart coupling element fixed to said support device define a recess, and said latch member projects into said recess in alignment with said interlock element.

4. A machine according to claim 1 wherein said support device comprises two parallel spaced apart wall members, spacers interposed between said wall members and connecting said wall members together, some of said spacers being on one side of said column and others being on the opposite side of said column for guiding said support device for moving freely vertically on said column.

5. A machine according to claim 1 wherein said support device comprises two parallel spaced apart wall members, said latch member comprises a lever arranged for pivoting between said wall members, and said lever has a short lever arm for pivoting into and out of engagement with said column and a long lever arm for being actuated by said interlock element.

6. The machine according to claim 5 wherein there are a series of teeth arranged lengthwise of said column and said shorter lever arm has a wedge-shaped edge for engaging with said teeth.

7. The machine according to claim 5 wherein said shorter lever arm terminates in a rounded end and there are a series of complimentarily shaped indentations on said column for being engaged by said end.

8. The machine according to claim 3 including a thrust bolt disposed in said shorter lever arm, said thrust bolt having a hard metallic end portion extending from said shorter lever arm, and there is softer member mounted to said column and extending at least over part of the length of said column, repeated engagement of said hard end portion with said softer member at selected positions causing indentation to be formed in said softer members in which said hard metallic end portion registers to effect engagement of said shorter lever arm with said column.

9. A machine according to claim 5 wherein said wall members each have in one edge a mutually aligned recess having open ends, a bar element fastened to the free end of said longer lever arm transversely to the plane in which said lever pivots, said bar element spanning across the space between said wall members with opposite ends extending beyond said recesses in each member, springs acting on said ends of said bar element in a direction :to pivot said lever such that said short lever arm maintains engagement with said column until said interlock element is actuated in said one direction sufficiently to strike said bar means and pivot said lever means to disengage said short lever arm from said column.

10. The machine according to claim 9 including lugs projecting respectively from the noninterfacing outer sides of said wall members toward said opposite ends of said bar element, and lugs on each of said opposite ends of said bar element projecting toward said lugs on the wall members, said springs comprising compression springs retained by said lugs on opposite sides of said wall members.

11. The machine according to claim 5 wherein:

said interlock element is a bolt, said wall members of said support device having corresponding edges proximate to said interlock element, a pair of bars extending between said edges to define a space between them into which said bolt can advance, when acutated by a predetermined amount, to get under the upper one of said bars for supporting said support device, further actuation of said bolt resulting in said bolt actuating said arm to disengage said short lever arm from said column.

12. The machine according to claim 11 wherein said bolt is tapered at an end that leads advancement into said support device between said bars.

13. A machine according to any one of claims 1 to 10 including a pneumatic cylinder actuator for actuating said interlock element.

14. The machine according to any one of claims 1 to 10 including a pneumatic cylinder for actuating said interlock element.

* * * * *

UNITED STATES PATENT AND TRADEMARK OFFICE

CERTIFICATE OF CORRECTION

PATENT NO. : 4,789,013

DATED : December 6, 1988

INVENTOR(S) : Hermann Kronseder

It is certified that error appears in the above—identified patent and that said Letters Patent is hereby corrected as shown below:

| | |
|---|---|
| Column 7, Line 17 | "corresponding" should be ---correspondingly--- |
| Column 8, Line 7 | "3" should be ---5--- |
| Column 8, Line 14 | "indentation" should be ---indentations--- |
| Column 8, Line 48 | "acutated" should be ---actuated--- |

Signed and Sealed this

Twenty-fifth Day of April, 1989

*Attest:*

DONALD J. QUIGG

*Attesting Officer*

*Commissioner of Patents and Trademarks*